US009220314B2

(12) United States Patent
Smirman

(10) Patent No.: US 9,220,314 B2
(45) Date of Patent: Dec. 29, 2015

(54) SYSTEM FOR CALCULATING FOREFOOT WEDGE ANGLE TO CORRECT PRONATION/SUPINATION

(71) Applicant: Marie Smirman, Rochester Hills, MI (US)

(72) Inventor: Marie Smirman, Rochester Hills, MI (US)

( * ) Notice: Subject to any disclaimer, the term of this patent is extended or adjusted under 35 U.S.C. 154(b) by 327 days.

(21) Appl. No.: 13/859,327

(22) Filed: Apr. 9, 2013

(65) Prior Publication Data

US 2014/0298600 A1 Oct. 9, 2014

Related U.S. Application Data

(63) Continuation-in-part of application No. 12/760,370, filed on Apr. 14, 2010, now Pat. No. 8,523,194.

(60) Provisional application No. 61/621,774, filed on Apr. 9, 2012.

(51) Int. Cl.

| | |
|---|---|
| ***A43D 999/00*** | (2006.01) |
| ***A43B 7/14*** | (2006.01) |
| ***A43B 7/24*** | (2006.01) |
| ***A43B 17/02*** | (2006.01) |

(52) U.S. Cl.

CPC ..... *A43B 7/1425* (2013.01); *A43B 7/14* (2013.01); *A43B 7/145* (2013.01); *A43B 7/1435* (2013.01); *A43B 7/24* (2013.01); *A43B 17/023* (2013.01); *A43D 999/00* (2013.01)

(58) Field of Classification Search

CPC ..... A43B 7/00; A43B 7/14; A43D 999/00
USPC ..... 12/142 R, 142 N, 146 M; 36/142, 143, 36/144, 88

See application file for complete search history.

(56) References Cited

U.S. PATENT DOCUMENTS 4,578,882 A * 4/1986 Talarico, II ..... A43B 13/14 36/103
4,685,227 A * 8/1987 Simmons ..... A43B 17/02 36/127
5,345,701 A * 9/1994 Smith ..... A61F 5/14 36/127
8,601,722 B2 * 12/2013 Frye ..... A43B 3/163 36/140
8,631,592 B2 * 1/2014 Adair ..... A43B 1/0081 36/100
2002/0056209 A1 * 5/2002 Clough ..... A43B 7/145 36/88
2002/0139011 A1 * 10/2002 Kerrigan ..... A43B 7/142 36/144
2005/0166423 A1 * 8/2005 Norton ..... A43B 13/04 36/28
2006/0000114 A1 * 1/2006 Love ..... A43B 17/023 36/43
2006/0053664 A1 * 3/2006 Tager ..... A61F 5/14 36/144
2006/0059726 A1 * 3/2006 Song ..... A43B 7/142 36/142
2009/0064539 A1 * 3/2009 Park ..... A43B 13/148 36/88
2010/0263231 A1 * 10/2010 Smirman ..... A43B 5/1641 36/43
2011/0061268 A1 * 3/2011 Park ..... A43B 13/12 36/25 R
2011/0131840 A1 * 6/2011 Yang ..... A61F 5/14 36/144
2014/0298600 A1 * 10/2014 Smirman ..... A43B 7/1425 12/142 R

* cited by examiner

*Primary Examiner* — Marie Bays

(74) *Attorney, Agent, or Firm* — Preston Smirman; Smirman IP Law, PLLC

(57) ABSTRACT

Systems and methods for forming a forefoot wedge insert are described for a piece of footwear, such as but not limited to ice skating boots, for correcting a pronation and/or supination condition wherein the insert permits the subtalar joint of the affected foot to be placed and/or maintained in a neutral position. In this manner, the insert can provide the corrected foot with adequate balance relative to the skate blade during typical ice skating maneuvers.

3 Claims, 6 Drawing Sheets

SYSTEM FOR CALCULATING FOREFOOT WEDGE ANGLE TO CORRECT PRONATION/SUPINATION

CROSS-REFERENCE TO RELATED APPLICATION

The instant application is a continuation-in-part of U.S. patent application Ser. No. 12/760,370, filed Apr. 14, 2010, pending, and claims priority to U.S. Provisional Patent Application Ser. No. 61/621,774, filed Apr. 9, 2012, the entire specifications of both of which are expressly incorporated herein by reference.

FIELD OF THE INVENTION

The present invention relates generally to systems and methods for forming inserts for footwear, such as shoes or boots, and, more specifically to systems and methods for forming a forefoot wedge insert for a piece of footwear, such as but not limited to ice skating boots, for correcting a pronation and/or supination condition wherein the insert permits the subtalar joint of the affected foot to be placed and/or maintained in a neutral position.

BACKGROUND OF THE INVENTION

Referring to FIGS. 1-3*b*, conventional skating boots 10 are typically constructed with a relatively stiff leather upper 12 built about a boot-like sole 14 and heel 16 platform, which are likewise relatively stiff. Accordingly, when the wearer's foot is placed into the skating boot 10, and the skating boot 10 is laced up, unless the skating boot 10 essentially form fits the wearer's foot, or the wearer has a relatively straight lower leg LL (e.g., tibia relative to the vertical axis A extending downwardly through the knee K) or the wearer has a relatively stable subtalar joint (e.g., see FIG. 2), some wearer's feet F have a tendency to roll about the ankle joint (e.g., display eversion and/or inversion characteristics with respect to the subtalar joint area). This situation is especially problematic for individuals with existing pronation and/or supination conditions, wherein significant rearfoot and/or forefoot valgus and/or varus conditions are present. For example, some of these individuals may have "bowed" lower legs LL (e.g., laterally or medially), and as a result, the supinators (e.g., see FIG. 3*b*) and/or the pronators (e.g., see FIG. 3*a*) attempt to compensate by maintaining a neutral or level foot posture relative to the skate blade SB. In these situations, the wearer of the skating boot 10 attempts to compensate for the valgus/varus conditions to maintain a subtalar neutral position in order to keep the skate blade vertically aligned with the knee/upper portion of the lower leg (e.g., proximal portion of the tibia) so as to maintain proper balance. However, because the toe cap of the skating boot forces the wearer's toes and/or forefoot down onto the foot bed surface, and because typical ice skating maneuvers with ice skating boots require the foot to be able to balance on a point of a rockered skating blade, it is virtually impossible for the wearer to consistently and constantly maintain a subtalar neutral position (i.e., neither pronating or supinating), especially if one or both of the wearer's feet naturally pronates and/or supinates to any significant degree. Needless to say, skating performance would be expected to significantly suffer under these particular circumstances.

Because of these different mechanical conditions being present, the ice skater's foot needs to be positioned differently in the skate boot than in a conventional shoe in order to maintain constant and consistent balance over the skate blade. Without this balance, the muscles, bones, tendons and ligaments of the skater's foot (as well as other parts of the body) can become stressed and/or injured as the ankle repeatedly rolls, or attempts to roll, either laterally or medially.

Therefore, it would be advantageous to provide new and improved systems and methods for forming an insert for a piece of footwear, such as but not limited to ice skating boots, for correcting a pronation and/or supination condition wherein the insert permits the subtalar joint of the affected foot to be placed in and/or maintained in a neutral position, that overcomes at least one of the aforementioned problems.

SUMMARY OF THE INVENTION

In accordance with the general teachings of the present invention, new and improved systems and methods are provided for forming a forefoot wedge insert for a piece of footwear, such as but not limited to ice skating boots, for correcting a pronation and/or supination condition wherein the insert permits the subtalar joint of the affected foot to be placed and/or maintained in a neutral position. In this manner, the insert can provide the corrected foot with adequate balance relative to the skate blade during typical ice skating maneuvers.

In accordance with a first embodiment of the present invention, a method for forming a forefoot wedge insert for a piece of footwear for correcting a pronation and/or supination condition is provided, wherein the insert permits a subtalar joint of an affected foot to be placed and/or maintained in a neutral position, comprising:

determining a rearfoot valgus or varus angle;

determining a forefoot valgus or varus angle;

combining the rearfoot valgus or varus angle and the forefoot valgus or varus angle to determine a total wedge angle; and forming the wedge insert, wherein the wedge insert includes an angle substantially corresponding to the total wedge angle.

In accordance with a second embodiment of the present invention, a method for forming a forefoot wedge insert for a piece of footwear for correcting a pronation and/or supination condition is provided, wherein the piece of footwear includes a heel rise, wherein the insert permits a subtalar joint of an affected foot to be placed and/or maintained in a neutral position, comprising:

determining a rearfoot valgus or varus angle;

determining a forefoot valgus or varus angle;

combining the rearfoot valgus or varus angle and the forefoot valgus or varus angle to determine a wedge angle;

determining a heel rise correction angle, wherein the heel rise correction angle is determined by the formula: arc sin (heel rise/length of the foot), wherein the length of the foot is measured from a heel to a toe joint of the foot;

combining the wedge angle and the heel rise correction angle to determine a total wedge angle; and forming the wedge insert, wherein the wedge insert includes an angle substantially corresponding to the total wedge angle.

In accordance with a third embodiment of the present invention, a method for forming and orienting a forefoot wedge insert for a piece of footwear for correcting a pronation and/or supination condition is provided, wherein the piece of footwear includes a heel rise, wherein the insert permits a subtalar joint of an affected foot to be placed and/or maintained in a neutral position, comprising:

determining a rearfoot valgus or varus angle;

determining a forefoot valgus or varus angle;

combining the rearfoot valgus or varus angle and the forefoot valgus or varus angle to determine a wedge angle;

determining a heel rise correction angle, wherein the heel rise correction angle is determined by the formula: arc sin (heel rise/length of the foot), wherein the length of the foot is measured from a heel to a toe joint of the foot;

combining the wedge angle and the heel rise correction angle to determine a total wedge angle;

forming the wedge insert, wherein the wedge insert includes an angle substantially corresponding to the total wedge angle; and determining an orientation angle for orienting the wedge insert relative to the forefoot, wherein the orientation angle is determined by the formula: $\theta_1$=[(varus or valgus angle)/((varus or valgus angle)+heel correction angle)]×90°, wherein $\theta_1$ is an angle measured on a horizontal footbed of the piece of footwear from a line of a toe joint of the foot to a tapered edge of the wedge insert.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Other advantages of the present invention will be readily appreciated as the same becomes better understood by reference to the following detailed description when considered in connection with the accompanying drawings wherein.

The same reference numerals refer to the same parts throughout the various Figures.

DETAILED DESCRIPTION OF THE INVENTION

Figure 1:
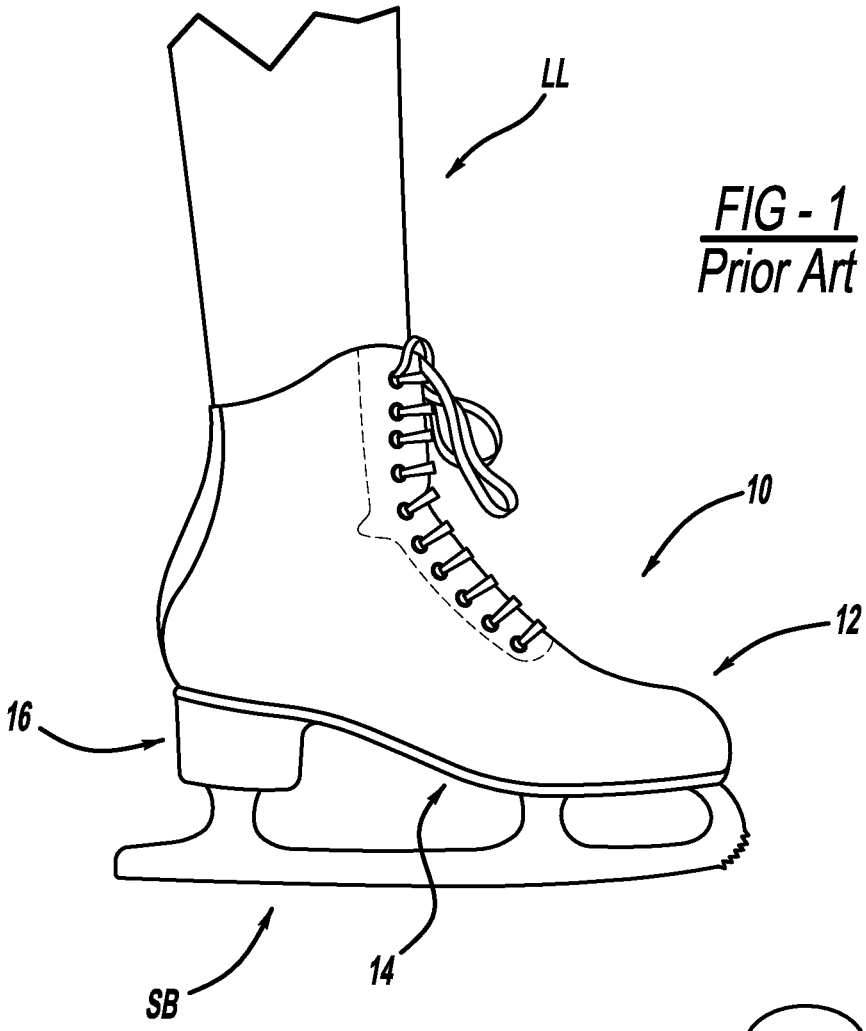
FIG - 1 Prior Art
FIG. 1 is an elevational view of a boot, in accordance with the prior art.
Figure 2:
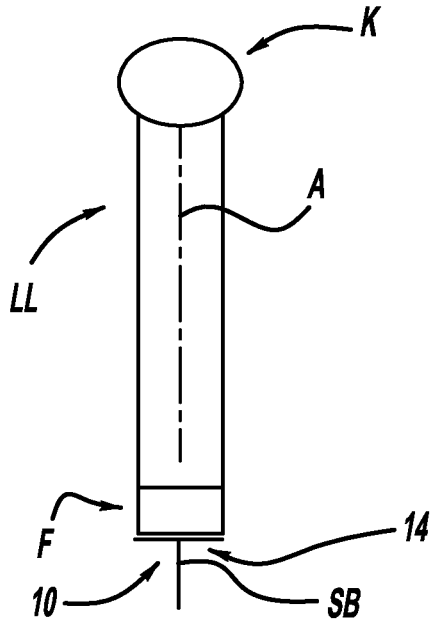
FIG - 2 Prior Art
FIG. 2 is a schematic view of a relatively straight lower leg having a foot in the subtalar neutral position while in a skating boot, in accordance with the prior art.

The following description of the preferred embodiment(s) is merely exemplary in nature and is in no way intended to limit the invention, or uses.

Referring generally to FIGS. 3*c*-8, a new and improved forefoot wedge insert 30 is provided for a piece of footwear 32, e.g., a boot, such as, but not limited to ice skating boots, or a shoe, such as, but not limited to exercise, therapeutic, or physiological footwear. The forefoot wedge insert 30 can be formed of any formable or moldable material that is substantially firm, yet comfortable, when formed, molded, cured or dried. The formable or moldable material can be used to uplift the forefoot area 36 of the wearer's foot 38 to cause the subtalar joint of the wearer to assume and/or maintain a neutral position (or as close to neutral as possible). By way of a non-limiting example, the vertical leg/foot arrangement is being "shimmed level" to the boot or shoe bottom medially/laterally (as the case may require) in the neutral position (e.g., subtalar neutral) in order to achieve relatively good alignment for the body when skating on a rockered blade (or rockered wheels for inline skates) or walking on a rockered sole (e.g., for exercise, therapeutic, or physiological footwear). In this manner, the wearer can more easily maintain the skate blade 40 in vertical alignment with the axis through the knee 42/upper leg area 44, whether they be supinators (e.g., see FIGS. 4*a* and 4*c*) or pronators (e.g., see FIGS. 4*b* and 4*d*). The wearer can then more easily balance over the skate blade 40, generally considered to be a prerequisite for proper skating technique.

In order to determine what the overall wedge height or thickness of the forefoot wedge insert 30 should be it is first necessary to determine the forefoot varus/valgus angle and the rearfoot varus/valgus angle are, and then combine the two angles to geometrically determine the overall wedge height or thickness.

With respect to pronators, the respective forefoot/rearfoot measurements will yield two different varus angles; however, it should be appreciated that one of the measurements might yield either a 0 degree angle or a very slight valgus angle (e.g., typically in the rearfoot angle measurement). However, pronators will typically yield an overall or total positive varus angle result.

With respect to supinators, the respective forefoot/rearfoot measurements will yield two different valgus angles; however, it should be appreciated that one of the measurements might yield either a 0 degree angle or a very slight varus angle (e.g., typically in the rearfoot angle measurement). However, supinators will typically yield an overall or total negative valgus angle result.

Figure 3A:
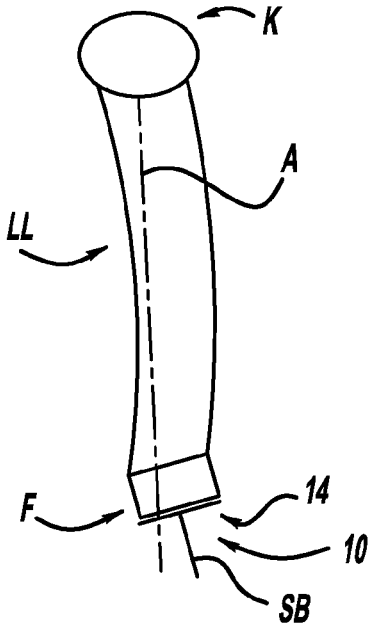
FIG - 3a Prior Art
FIG. 3*a* is a front schematic view of a relatively bowed lower right leg having a foot in the subtalar supinated position while in a skating boot, in accordance with the prior art.
Figure 3B:
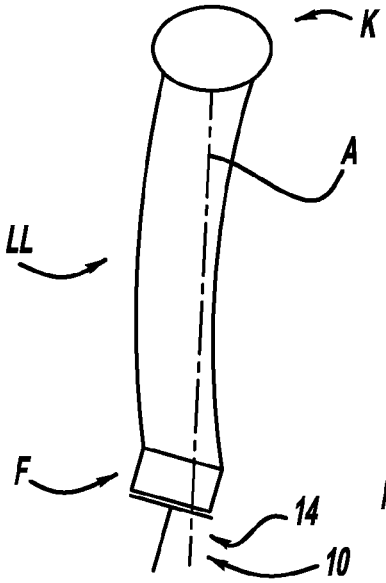
FIG - 3b Prior Art
FIG. 3*b* is a front schematic view of a relatively bowed lower right leg having a foot in the subtalar pronated position while in a skating boot, in accordance with the prior art.
Figure 3C:
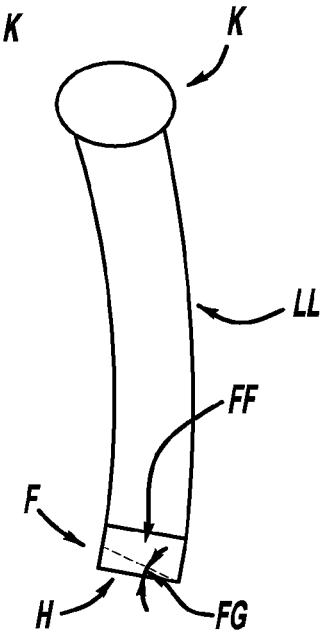
FIG. 3*c* is a front schematic view of a measurement step for measuring the forefoot valgus angle of the foot depicted in FIG. 3*a* in order to form the forefoot wedge insert of the present invention, in accordance with a first embodiment of the present invention.

Referring specifically to FIG. 3*c*, to determine the forefoot valgus angle for a supinator (or suspected supinator), the wearer's foot F can be held in non-weight bearing subtalar neutral position (e.g., by a podiatrist), or as close thereto as possible. An appropriate diagnostic tool, such as but not limited to a goniometer can be used to measure the valgus angle FG formed by the tilt of the bottom of the forefoot FF (indicated by the dotted line) relative to the bottom of the heel portion H. If the wearer's other foot is also affected, a similar measurement should be done for the other foot.

Figure 3D:
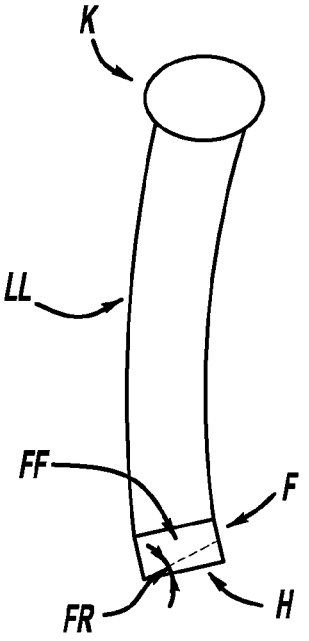
FIG. 3*d* is a front schematic view of a measurement step for measuring the forefoot varus angle of the foot depicted in FIG. 3*b* in order to form the forefoot wedge insert of the present invention, in accordance with a second embodiment of the present invention.

Referring specifically to FIG. 3*d*, to determine the forefoot varus angle for a pronator (or suspected pronator), the wearer's foot F can also held in non-weight bearing subtalar neutral position (e.g., by a podiatrist), or as close thereto as possible. An appropriate diagnostic tool, such as but not limited to a goniometer can be used to measure the varus angle FR formed by the tilt of the bottom of the forefoot FF (indicated by the dotted line) relative to the bottom of the heel portion H. If the wearer's other foot is also affected, a similar measurement should be done for the other foot.

Figure 3E:
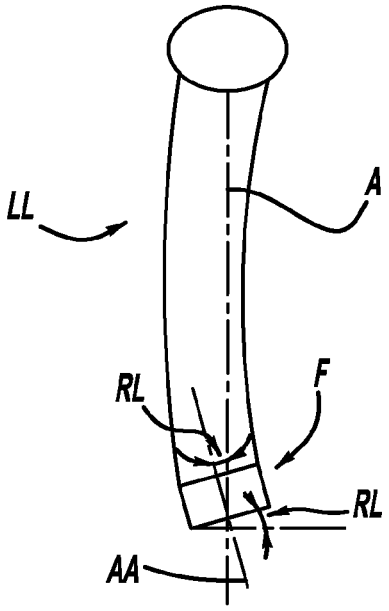
FIG. 3*e* is a rear schematic view of a measurement step for measuring the rearfoot valgus angle of the foot depicted in FIG. 3*a* in order to form the forefoot wedge insert of the present invention, in accordance with a third embodiment of the present invention.

Referring specifically to FIG. 3*e*, to determine the rearfoot valgus angle RL for a supinator (or suspected supinator), the wearer's foot F can again be held in non-weight bearing subtalar neutral position (e.g., by a podiatrist) or as close thereto as possible. An appropriate diagnostic tool, such as but not limited to a goniometer can be used to measure the valgus angle RL formed by the intersection of the vertical axis A extending downwardly through the bottom or lower third of the tibia (e.g., the lower leg area) and the vertical axis AA extending upwardly through the middle of the heel portion H. The intersection of these two axes A, AA forms a vertex of the rearfoot valgus angle RL. In this manner, it enables measuring the valgus angle formed by the intersection of the vertical axis extending downwardly through the lower leg area and the vertical axis extending upwardly through the middle of the heel portion. Additionally, an alternative method of determining the rearfoot valgus angle RL for a supinator (or suspected supinator), includes the wearer's foot F being held in non-weight bearing subtalar neutral position (e.g., by a podiatrist), or as close thereto as possible, wherein an appropriate diagnostic tool, such as but not limited to a goniometer can be used to measure the valgus angle RL formed by an imaginary horizontal level line HL (e.g., that is 90 degrees perpendicular to the vertical axis A extending downwardly through the lower leg area) and a bottom most edge E of the heel portion H. The angles formed by this method and the first method of this paragraph are believed to be substantially equivalent. If the wearer's other foot is also affected, similar measurement(s) should be done for the other foot.

Figure 3F:
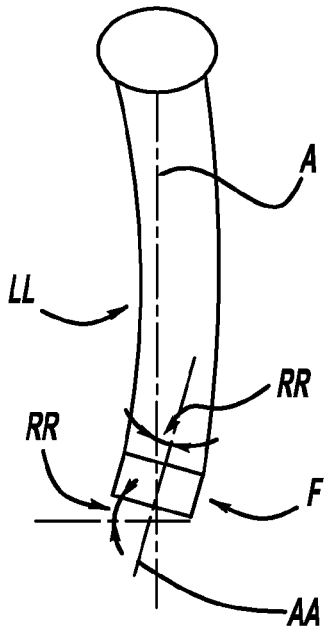
FIG. 3*f* is a rear schematic view of a measurement step for measuring the rearfoot varus angle of the foot depicted in FIG. 3*b* in order to form the forefoot wedge insert of the present invention, in accordance with a fourth embodiment of the present invention.
Figure 4A:
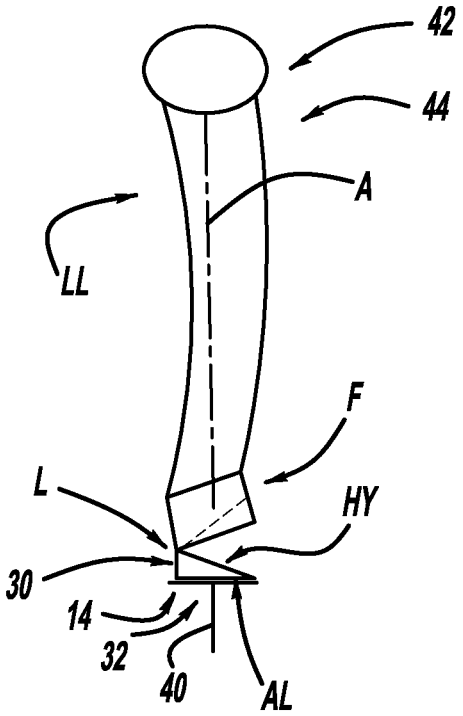
FIG. 4*a* is a front schematic view of the foot depicted in FIG. 3*a* about to be corrected with a forefoot wedge insert so that the subtalar joint will be in a neutral position while in the skating boot and/or the skate blade is substantially aligned with the vertical axis through the knee/upper leg area, in accordance with a fifth embodiment of the present invention.
Figure 4B:
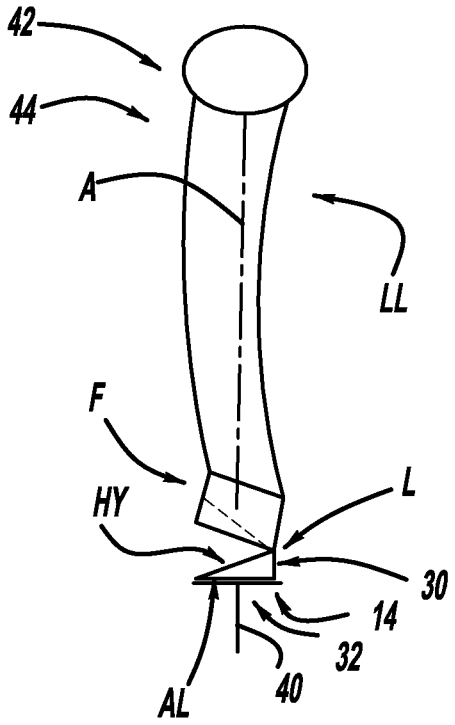
FIG. 4*b* is a front schematic view of the foot depicted in FIG. 3*b* about to be corrected with a forefoot wedge insert so that the subtalar joint will be in a neutral position while in the skating boot and/or the skate blade is substantially aligned with the vertical axis through the knee/upper leg area, in accordance with a sixth embodiment of the present invention.
Figure 4C:
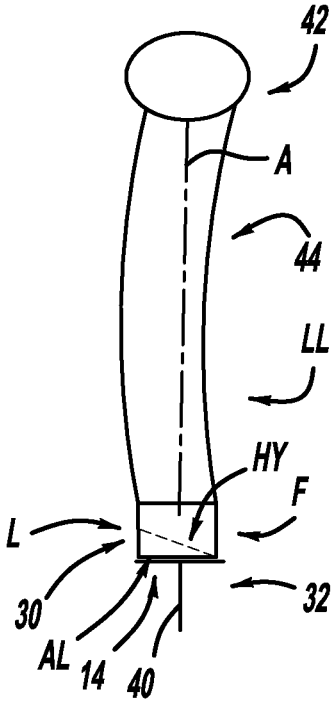
FIG. 4*c* is a front schematic view of the foot depicted in FIG. 3*a* corrected with a forefoot wedge insert so that the subtalar joint will be in a neutral position while in the skating boot and/or the skate blade is substantially aligned with the vertical axis through the knee/upper leg area, in accordance with a seventh embodiment of the present invention.
Figure 4D:
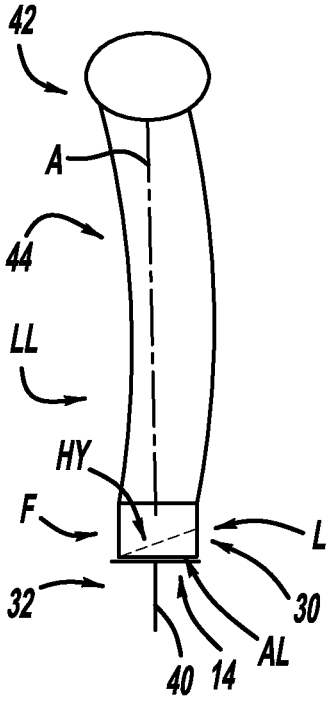
FIG. 4*d* is a front schematic view of the foot depicted in FIG. 3*b* corrected with a forefoot wedge insert so that the subtalar joint will be in a neutral position while in the skating boot and/or the skate blade is substantially aligned with the vertical axis through the knee/upper leg area, in accordance with an eighth embodiment of the present invention.

Referring specifically to FIG. 3*f*, to determine the rearfoot varus angle RR for a pronator (or suspected pronator), the wearer's foot F can again be held in non-weight bearing subtalar neutral position (e.g., by a podiatrist), or as close thereto as possible. An appropriate diagnostic tool, such as but not limited to a goniometer can be used to measure the varus angle RR formed by the intersection of the vertical axis A extending downwardly through the lower leg area and the vertical axis AA extending upwardly through the middle of the heel portion H. The intersection of these two axes A, AA forms a vertex of the rearfoot varus angle RR. In this manner, it enables measuring the varus angle formed by the intersection of the vertical axis extending downwardly through the lower leg area and the vertical axis extending upwardly through the middle of the heel portion. Additionally, an alternative method of determining the rearfoot varus angle RR for a pronator (or suspected pronator), includes the wearer's foot F being held in non-weight bearing subtalar neutral position (e.g., by a podiatrist), or as close thereto as possible, wherein an appropriate diagnostic tool, such as but not limited to a goniometer can be used to measure the varus angle RR formed by an imaginary horizontal level line HL (e.g., that is 0 degrees perpendicular to the vertical axis A extending downwardly through the lower leg area) and a bottom most edge E of the heel portion H. The angles formed by this method and the first method of this paragraph are believed to be substantially equivalent. If the wearer's other foot is also affected, similar measurement(s) should be done for the other foot.

To determine the total wedge angle, and thus the overall wedge height or thickness of the forefoot wedge insert 30, the forefoot angle (whether it be varus or valgus in nature) can be combined with the rearfoot angle (whether it be varus or valgus in nature) according to the following formula: Total Wedge Angle=Forefoot Angle (+varus or −valgus)+Rearfoot Angle (+varus or −valgus).

By way of a non-limiting example, it should be appreciated that for certain types of footwear, e.g., rockered exercise shoes and/or the like, adjustments can be made to the Total Wedge Angle calculations set forth above. For example, in these types of footwear, the Total Wedge Angle may be reduced to achieve the desired corrective effect.

By way of a non-limiting example, a severely pronating individual has a right foot measure as follows: forefoot angle of +15 varus degrees and a rearfoot angle of +10 varus degrees. Accordingly, the total wedge angle for this right foot would be +25 varus degrees. The same individual has a left foot with the following measurements: angle of +2 varus degrees and a rearfoot angle of +1 varus degrees. Accordingly, the total wedge angle for this left foot would only be +3 varus degrees. This example highlights the necessity of taking individual measurements for each foot as there may be significant angle differences there between.

By way of another non-limiting example, a severely supinating individual has a right foot measure as follows: forefoot angle of −20 valgus degrees and a rearfoot angle of −8 valgus degrees. Accordingly, the total wedge angle for this right foot would be −28 valgus degrees. The same individual has a left foot with the following measurements: angle of −4 valgus degrees and a rearfoot angle of 0 degrees. Accordingly, the total wedge angle for this left foot would only be −4 valgus degrees. Again, this example highlights the necessity of taking individual measurements for each foot as there may be significant angle differences there between.

By way of still another non-limiting example, an individual without any overt indication of severe pronation/supination conditions has a right foot measure as follows: forefoot angle of +2 varus degrees and a rearfoot angle of −2 valgus degrees. Accordingly, the total wedge angle for this right foot would be 0 degrees, indicating that a forefoot wedge insert is not needed for this right foot. The same individual has a left foot with the following measurements: angle of −3 valgus degrees and a rearfoot angle of −3 valgus degrees. Accordingly, the total wedge angle for this left foot would be −6 valgus degrees. This example again highlights the necessity of taking individual measurements for each foot.

Although the previously described methodology for determining the total wedge angle is more than satisfactory, an option additional calculation may be employed to obtain an even more accurate wedge angle.

Figure 5:
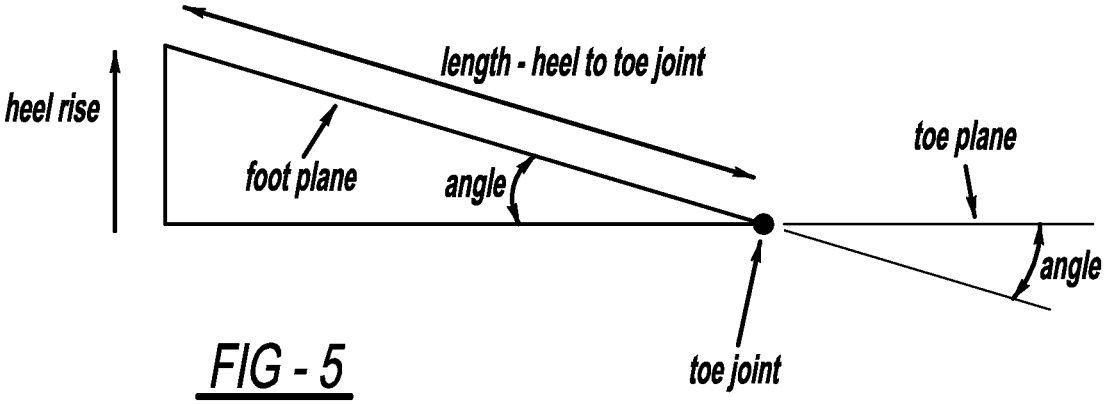
FIG. 5 is a graphical illustration of a heel rise calculation, in accordance with a ninth embodiment of the present invention.

Because certain footwear, especially ice skating boots, have a heel rise, an additional calculation may be performed to determine an additional term to add to the previously described total wedge angle. By way of a non-limiting example, the heel rise correction angle calculation is essentially a geometric calculation, as generally shown in FIG. 5. Solving for this additional heel rise correction angle, the following formula may be used: heel rise correction angle=arc sin(heel rise/length of foot, from heel to toe joint).

By way of a non-limiting example, when the forefoot is tilted laterally or medially up from the footbed to correct pronation or supination, the angle of the toe plane from the foot plane is preserved and therefore the toes must also be supported along their plane direction.

Additionally, when the heel rise correction angle is added to the pronation/supination angle (i.e., the previously described total wedge angle), the resulting wedge should then be oriented in the horizontal plane differently than if there was no heel rise present. By way of a non-limiting example, the "thick" side of the wedge should be facing more towards the front side of the foot rather than directly medially (e.g., for pronation) or laterally (e.g., for supination). The extent to which the "thick" side of the wedge is turned toward the front of the foot depends on the relative size of the angles of pronation or supination versus the heel rise correction angle.

By way of a non-limiting example, the larger the heel rise correction angle is in comparison to the pronation/supination angle (i.e., the previously described total wedge angle), the more the "thick" side of the wedge should aim towards the front of the foot, such that the resulting wedge supports the ball of the foot and toes with substantially even pressure in the subtalar neutral position.

By way of a non-limiting example, solving for this orientation angle, the following formula may be used: $\theta_1$ (i.e., orientation angle)=[(varus or valgus angle)/((varus or valgus angle)+heel correction angle)]×90°, where $\theta_1$ is the angle measured on the horizontal footbed from the line of the toe joint to the "thin" edge of the wedge (e.g., see FIG. 6).

Figure 6:
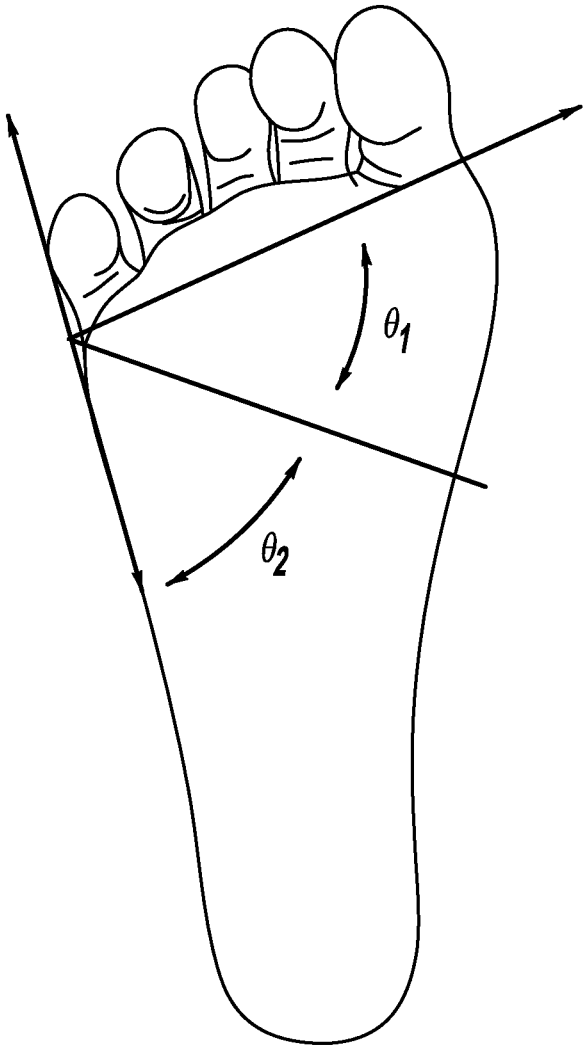
FIG. 6 is a graphical illustration of a wedge orientation calculation, in accordance with a tenth embodiment of the present invention.

Still referring to FIG. 6, the orientation angle may also be defined as the inverse of the fraction in the formula multiplied by 90° which would calculate to be $\theta_2$, locating the "thin" edge of the wedge in the same orientation. By way of a non-limiting example, if $\theta_1=\theta_2=45°$, it means the pronation (or supination) angle=heel rise correction angle, where $\theta_1+\theta_2=(½)\ 90°=45°$ Once the total wedge angle and the optional heel correction angle have been determined, an appropriate geometric calculation can be performed to determine the required thickness or height (e.g., in inches, millimeters, centimeters, and/or the like) of the forefoot wedge insert 30, e.g., the height of leg L (i.e., the leg of the triangle directly opposite the vertex of the angle) formed when the two angles (i.e., forefoot and rearfoot) can be combined to form a triangle with an opposing edge of the wearer's foot bisecting the two extending lines (e.g., the adjacent leg AL and hypotenuse leg HY) from the angle. By way of a non-limiting example, the heel correction angle would almost certainly be a positive addition to the previously described combined pronation or supination angles, thus most probably increasing the height of the "thick" side of the resulting wedge.

Figure 8:
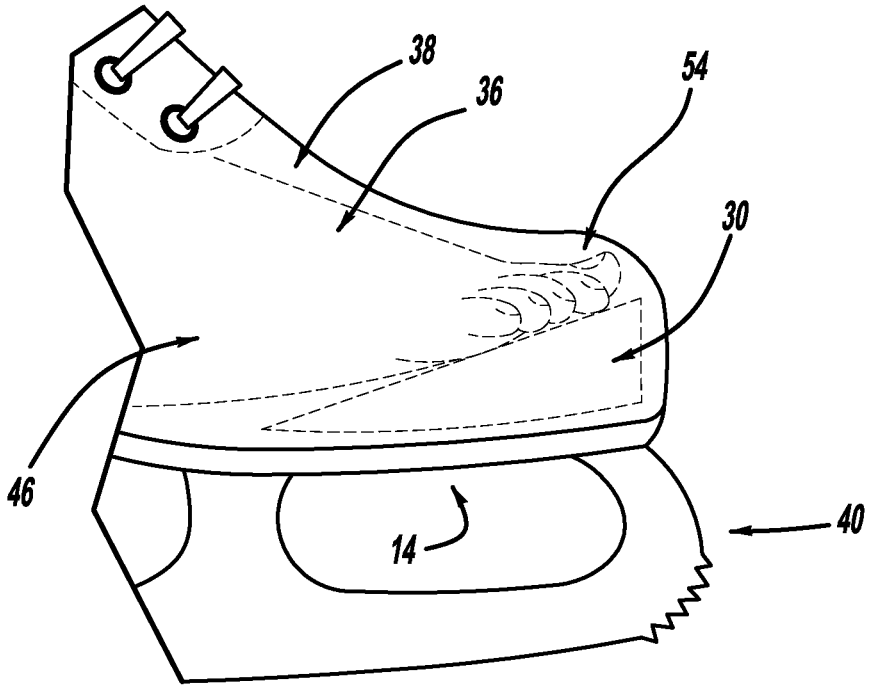
FIG. 8 is a partial elevational view of the wearer's foot inserted into the skating boot with the forefoot wedge insert of the present invention, in accordance with a thirteenth embodiment of the present invention.

Referring specifically to FIG. 8, the forefoot wedge insert 30 can extend from an area corresponding to the toes 54 extending back through the ball area 46 of the foot 38, i.e., the forefoot area 36, thus providing adequate balance for the wearer's foot 38 during typical ice skating maneuvers.

Figure 7A:
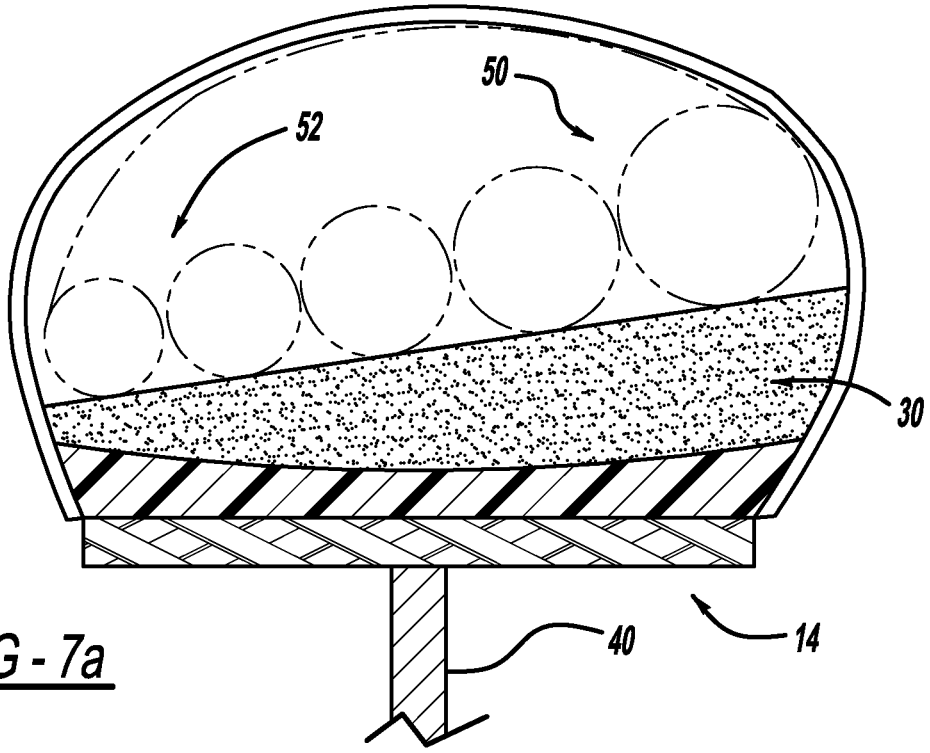
FIG. 7*a* is a front sectional view wherein the forefoot wedge insert of the present invention is correcting a pronating subtalar joint of the right foot so that the subtalar joint is in a neutral position while in the skating boot, in accordance with an eleventh embodiment of the present invention.
Figure 7B:
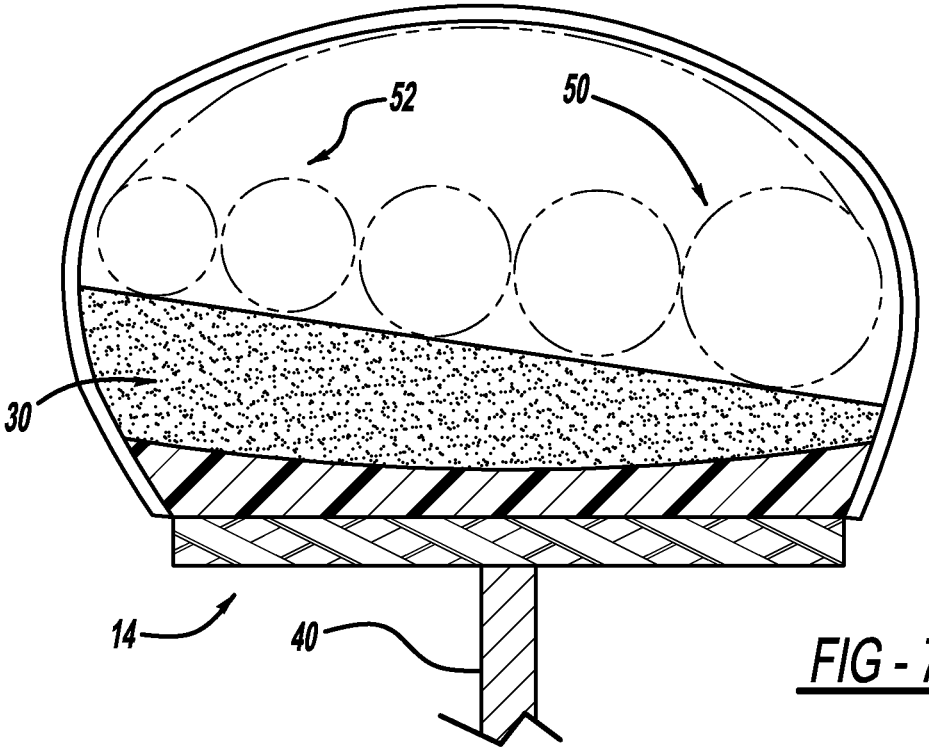
FIG. 7*b* is a front sectional view wherein the forefoot wedge insert of the present invention is correcting a supinating subtalar joint of the right foot so that the subtalar joint is in a neutral position while in the skating boot, in accordance with a twelfth embodiment of the present invention.
Figure 9:
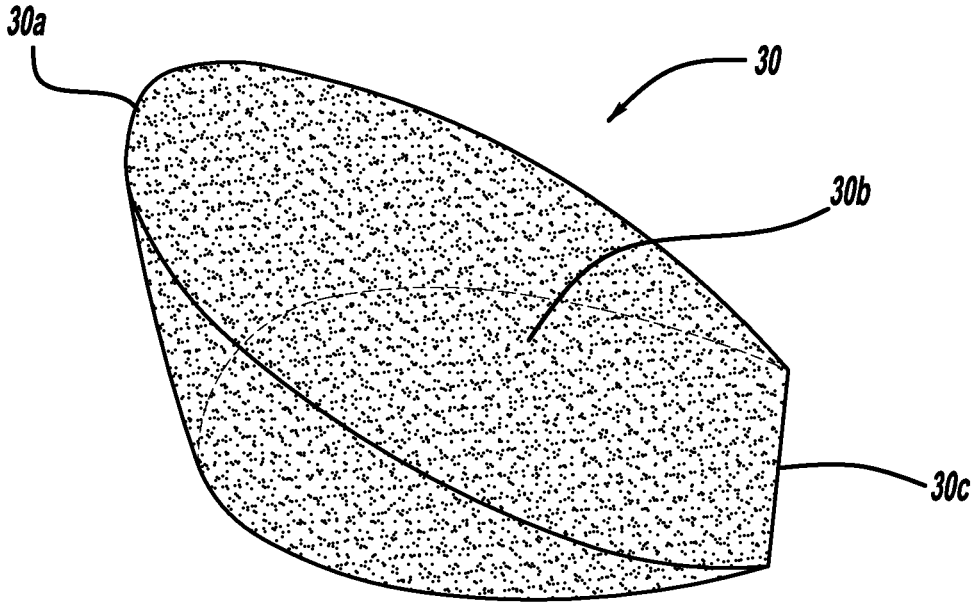
FIG. 9 is a perspective view of the forefoot wedge insert, in accordance with a fourteenth embodiment of the present invention.

Referring specifically to FIG. 9, the forefoot wedge insert 30 can have a substantially wedge-shaped portion 30*a* for uplifting one side of the wearer's forefoot (indicated by the dotted line) (e.g., see FIGS. 7*a*-7*b*), e.g., uplifting the "big toe side" of the forefoot for pronators (e.g., FIG. 7*a*) and uplifting the "pinky toe side" of the forefoot for supinators (e.g., FIG. 7*b*). A substantially planar portion 30*b* can provide a surface for the wearer's foot 38. The planar surface 30*b* gradually tapers towards the edge 30*c* opposing the wedge portion 30*a*. Thus, for most pronators, the thicker or higher side of the wedge insert 30, i.e., the wedge-shaped portion 30*a*, will be under the big toe 50 with the tapered portion 30*c* extending towards the ball area 46 (e.g., see FIG. 7*a*). In this manner, the forefoot area 46 (indicated by the dotted line) of the foot 38 can be uplifted by the wedge-shaped portion 30*a* to present a somewhat supinated posture; but in actuality, the wedge-shaped portion 30*a* is merely "leveling" the foot 38 to the foot bed such that the foot 38 cannot pronate thereon. Conversely, for most supinators, the thicker or higher side of the wedge insert 30, i.e., the wedge-shaped portion 30*a*, will be under the pinky toe 52 with the tapered portion 30*c* extending towards the big toe 50 and the ball area 46 (e.g., see FIG. 7*b*), respectively. In this manner, the forefoot area 46 (indicated by the dotted line) of the foot 38 can be uplifted by the wedge-shaped portion 30*a* to present a somewhat pronated posture; but in actuality, the wedge-shaped portion 30*a* is merely "leveling" the foot 38 to the foot bed such that the foot 38 cannot supinate thereon.

The forefoot wedge insert 30 can be formed of any material that can be shaped or formed, e.g., by hand, machine, and/or the like. By way of a non-limiting example, the material can be formed of compressed materials (e.g., sawdust/resin mixtures and/or the like), shaped materials (e.g., foams, corks and/or the like), and/or the like, that are shaped or formed by hand or machine (e.g., cutting, shaving, and/or the like). Additionally, the forefoot wedge insert 30 can be formed by computer-aided design/manufacturing techniques (i.e., CAD-CAM) wherein the coordinates of the forefoot wedge insert 30 are entered into a computer program and a rapid prototyping machine forms the finished forefoot wedge insert 30 from a block of material. Regardless, the shape of the forefoot wedge insert 30 can be determined in any way (e.g., trial and error), and the forefoot wedge insert 30 shaped to an appropriate form, e.g., outside of the boot or shoe. However, the shaped forefoot wedge insert 30 would nonetheless still need to uplift the wearer's forefoot area 36 to cause the subtalar joint of the wearer to assume and/or maintain a neutral position to allow the wearer to more easily maintain the skate blade 40 in vertical alignment with the axis through the knee 42/upper leg area 44 to more easily balance over the skate blade 40.

By way of a non-limiting example, the material comprising the forefoot wedge insert 30 should be at least as firm as the foot bed of the skate boot or shoe so as not to deform in any appreciable manner. If the material deforms to any significant degree, the requisite uplifting feature of the forefoot wedge insert 30 could be compromised. Accordingly, relatively hard or firm plastics, foams, gels and/or the like would be most suitable for forming the forefoot wedge insert 30.

As previously noted, the orientation of the forefoot wedge insert 30 will depend on the particular foot configuration of the wearer. For example, pronators will typically use a forefoot wedge insert 30 wherein the thickest portion of the forefoot wedge insert 30 can be placed under the big toe 50, with the forefoot wedge insert 30 gradually tapering away towards the pinky toe 52 and the ball area 46 of the foot 38 (e.g., see FIG. 7*a*). For another example, supinators will typically use a forefoot wedge insert 30 wherein the thickest portion of the forefoot wedge insert 30 can be placed under the pinky toe 52, with the forefoot wedge insert 30 gradually tapering away towards the big toe 50 and the ball area 46 of the foot 38 (e.g., see FIG. 7*b*).

The forefoot wedge insert 30 can easily be placed into and removed from the piece of footwear without having to tape, glue or otherwise secure it in place against the interior side of the piece of footwear proximate to the forefoot area 36. In this manner, the wearer can use the forefoot wedge insert 30 in multiple pieces of footwear. However, it should also be appreciated that the wearer can also tape, glue or otherwise secure the forefoot wedge insert 30 in place against the interior side of the piece of footwear proximate to the forefoot area 36. Regardless, use of the forefoot wedge insert 30 can provide the wearer's foot with a "custom fit" to the boot 32 or shoe 34.

It should be noted that the forefoot wedge insert 30 can be made to correct deficiencies in already produced boots or shoes that require the wearer to use a forefoot wedge insert to correct a pronation, supination, and/or other foot condition. By way of a non-limiting example, appropriate materials and instructions for the use thereof can be provided in a kit form, allowing wearers of these boots and shoes to form inserts to overcome the afore-mentioned problems.

Although the present invention has been described primarily in reference to ice skating boots (e.g., figure skating boots, hockey boots, and/or the like) and exercise, therapeutic, or physiological footwear, it should be noted that the present invention can be used with any type of footwear, especially those that require the wearer to use a forefoot wedge insert to correct a pronation, supination, and/or other foot condition.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for forming a forefoot wedge insert for a piece of footwear for correcting a pronation and/or supination condition, wherein the insert permits a subtalar joint of an affected foot to be placed and/or maintained in a neutral position, comprising:

determining a rearfoot valgus or varus angle;

determining a forefoot valgus or varus angle;

combining the rearfoot valgus or varus angle and the forefoot valgus or varus angle to determine a total wedge angle; and forming the wedge insert, wherein the wedge insert includes an angle substantially corresponding to the total wedge angle.

2. A method for forming a forefoot wedge insert for a piece of footwear for correcting a pronation and/or supination condition, wherein the piece of footwear includes a heel rise, wherein the insert permits a subtalar joint of an affected foot to be placed and/or maintained in a neutral position, comprising:

determining a rearfoot valgus or varus angle;

determining a forefoot valgus or varus angle;

combining the rearfoot valgus or varus angle and the forefoot valgus or varus angle to determine a wedge angle;

determining a heel rise correction angle, wherein the heel rise correction angle is determined by the formula: arc sin(heel rise/length of the foot), wherein the length of the foot is measured from a heel to a toe joint of the foot;

combining the wedge angle and the heel rise correction angle to determine a total wedge angle; and forming the wedge insert, wherein the wedge insert includes an angle substantially corresponding to the total wedge angle.

3. A method for forming and orienting a forefoot wedge insert for a piece of footwear for correcting a pronation and/or supination condition, wherein the piece of footwear includes a heel rise, wherein the insert permits a subtalar joint of an affected foot to be placed and/or maintained in a neutral position, comprising:

determining a rearfoot valgus or varus angle;

determining a forefoot valgus or varus angle;

combining the rearfoot valgus or varus angle and the forefoot valgus or varus angle to determine a wedge angle;

determining a heel rise correction angle, wherein the heel rise correction angle is determined by the formula: arc sin(heel rise/length of the foot), wherein the length of the foot is measured from a heel to a toe joint of the foot;

combining the wedge angle and the heel rise correction angle to determine a total wedge angle;

forming the wedge insert, wherein the wedge insert includes an angle substantially corresponding to the total wedge angle; and determining an orientation angle for orienting the wedge insert relative to the forefoot, wherein the orientation angle is determined by the formula: $\theta_1$=[(varus or valgus angle)/((varus or valgus angle)+heel correction angle)]× 90°, wherein $\theta_1$ is an angle measured on a horizontal footbed of the piece of footwear from a line of a toe joint of the foot to a tapered edge of the wedge insert.

* * * * *